United States Patent [19]

Wilson

[11] 4,054,276

[45] Oct. 18, 1977

[54] PROCESS AND APPARATUS FOR COOLING HOT ROLLED STEEL ROD

[75] Inventor: Norman A. Wilson, Shrewsbury, Mass.

[73] Assignee: Morgan Construction Company, Worcester, Mass.

[21] Appl. No.: 614,301

[22] Filed: Sept. 17, 1975

Related U.S. Application Data

[62] Division of Ser. No. 516,767, Oct. 21, 1974, Pat. No. 3,930,900.

[51] Int. Cl.[2] ..... C21D 9/56

[52] U.S. Cl. ..... 266/106; 72/201; 140/2

[58] Field of Search ..... 148/155, 156; 266/3 R, 266/5 R, 102, 106, 111, 113, 249, 251, 258, 259; 34/13, 20, 105, 225; 72/200, 201, 202, 342, 364; 140/2

[56] References Cited

U.S. PATENT DOCUMENTS

| | | | |
|---|---|---|---|
| 3,390,871 | 7/1968 | McLean et al. | 140/2 X |
| 3,584,852 | 6/1971 | Leland | 266/5 R |
| 3,718,024 | 2/1973 | Vitelli | 266/3 R X |
| 3,720,544 | 3/1973 | Entringer | 148/153 |
| 3,801,265 | 4/1974 | Bricmont | 266/5 R |

FOREIGN PATENT DOCUMENTS

| | | | |
|---|---|---|---|
| 1,154,134 | 9/1963 | Germany | 266/259 |
| 192,054 | 1964 | Sweden | 266/259 |

*Primary Examiner*—Gerald A. Dost
*Assistant Examiner*—Paul A. Bell

[57] ABSTRACT

Apparatus for conveying an elongated hot-rolled steel rod in off-set form on a conveyor through a series of cooling chambers. Each chamber comprises a stationary lower section and a removable cover section, the interior walls of each being heat reflective. Each chamber is also provided with tubes supported adjacent the interior walls and controlled in temperature by gas passing through said tubes, said gas being cold or hot, the hot gas being supplied from a plurality of separately controlled burners. The tubes differentially control the rate of heat radiation from the rod rings to compensate for the different rates of radiational heat loss emanating from the top and sides of the rod rings so as to cause the rod to cool uniformly. The side walls of the chamber are provided with adjustable apertures for the escape of radiant energy from the sides of the rod rings. Means are provided for controllably lifting the roof from its completely closed position to one in which the top of the lower section is entirely exposed. Means are also provided for blowing cooling air through the rings. The apparatus provides means for carrying out a process for controlling the loss of heat from the rod by applying radiant heat selectively to the rod, by reflection from the interior walls or by the heated or cooled tubes, or both, substantially in inverse proportion to the accumulated mass of the rod from side to side of the conveyor.

4 Claims, 15 Drawing Figures

PROCESS AND APPARATUS FOR COOLING HOT ROLLED STEEL ROD

This is a division of application Ser. No. 516,767, filed Oct. 21, 1974, now U.S. Pat. No. 3,930,900.

BACKGROUND OF THE INVENTION

In the practice of methods for the controlled cooling of steel rod in sequence with hot rolling for the purpose of obtaining a rod which is suitable for subsequence processing to finished product without requiring additional heat treatment, a large measure of success has been achieved with plain carbon steels in the medium-to-high carbon content range, to the extent that now many grades of plain carbon steel are being cooled directly from rolling and processed thereafter into finished wire, and other products, without requiring any heat treatment. The process by which this is accomplished is described in the McLain et al U.S. Pat. No. 3,231,432. It involves hot-rolling the rod and directly thereafter coiling it onto an open conveyor in spread-out ring form while the microstructure of the steel is still in a condition of highly uniform, relatively small austenite grain size, and then cooling it rapidly through allotropic transformation by the application of a moving air stream to the rod while the rod is still spread out.

Certain alloy steels and low carbon steels, however, cannot tolerate the high cooling rates employed in the typical practice of the above-cited McLain process. For instance, a cooling rate of as low as 0.2° C/sec. is sometimes required. However, although the desirability of providing for such low cooling rates has been known for many years, and equipments have been available for 6 to 8 years in which the average cooling rate is sufficiently slow, a number of hitherto unsolved problems have been presented. Uniformity of cooling in all parts of the rod is the major problem, and the equipments such as ovens and insulated hot boxes which were capable of achieving those slow average cooling rates simply were incapable of producing the desired rod quality. The reason for the non-uniformity was not altogether apparent, and its explanation requires an understanding of various background factors. For instance, the conditions of rod delivery pose the initial problem. Modern high speed rod rolling mills deliver the rod at over 10,000 fpm (50 meters/sec.), at which speeds the rod cannot be handled in straight lengths. It must be coiled. If it is coiled into a bundle according to the universal practice before the above-cited McLain process, the resulting bundle represented a relatively confused mass. Uniform cooling was impossible with such bundles. One might suppose that such a bundle would cool very slowly uniformly, but in fact it does not when exothermic allotropic transformation of steel is involved. Coiling the rod onto a moving conveyor in spread-out ring form as in the McLain process reduced the confusion of the bundle, but it still left the rod mass somewhat more compacted at the sides of the conveyor than at the center. Obviously, non-uniform cooling rates resulted from this, but the interesting feature of the McLain process was that when medium to high plain carbon steels were rolled, the uniform and small austenite grains transformed so rapidly that the non-uniform cooling rates which inherently resulted from the ring configuration, did not have time enough to result in vastly different average temperatures for transformation. The result was to provide a rod which had adequately uniform physical properties in spite of the non-uniformity of cooling on the conveyor. This fortuitous aspect of the McLain process, however, diminishes rapidly when the time of transformation is increased. Normal good cooling rates for medium tohigh carbon steels with the McLain process are about 7° C to 11° C/sec. or higher. Non-uniformity and poor quality are noted increasingly as the rate drops below 7° C/sec. Of course, many alloy steels and some low carbon steels require cooling rates very much lower than that in order to achieve the desired properties.

Several attempts have been made to coil the rod rings concentrically on both vertical and horizontal axes as, for example, in U.S. Pat. No. 3,494,603. Theoretically some improvement of uniformity of cooling ought to be accomplished thereby. However, nothing significant has been noted or published in this connection. With such equipments it is inevitable that the rod must rest on supports or on adjacent rings, and therefore, any improvement in uniformity for very slow cooling which might be obtained by using such equipments has not materialized. Moreover there are substantial disadvantages and complexities involved in the use of those equipments.

Another problem related to slow cooling concerns the various forms of heat loss and the ease of their respective controllabilities. The two principal forms of heat loss in the cooling of hot rolled rod are radiation and convection. At rolling temperature, about 1850° F (1000° C), the rod loses heat primarily by radiation. But when it has cool to the transformation range of approximately 1400° F (700° C), radiation plays a less prominent role (radiation heat loss decreases inversely as the 4th power of the difference in temperature Kelvin between the radiating body and the absorbing body). Thus, cooling by radiation and with only a minor amount of convection, 5.5 mm rod at 1400° F 700° C) will cool at an average rate across the conveyor of about 2° C/sec. Of course, forced air convection can be applied to increase the rate to values above 11° C/sec, but the point relative to slow cooling below 2° C/sec. is that the entire cooling can be done radiantly. This permits the use of a process which suppresses convection as much as possible and regulates the cooling rate by controlling the radiant cooling only.

Experience shows that when rod is laid out on a simple flat conveyor with minimal convection, the edges of the rings cool at about 1.6° C/sec. to 2.1° C/sec. depending upon the spacing of the rings. When slower rates applicable for given grades of steel are desired, placing the rings in an insulated box or oven can accomplish it but with such equipments, the same general relationship remains between sides and center and the cooling is non-uniform. This may be satisfactory for some products, but much greater uniformity is required in many cases, particularly for high alloy steels. In fact greater uniformity of cooling than is achieved with the usual practice of the above-cited McLain process, is even required in some plain high carbon grades.

Another major problem is the provision of equipment which is not only suitable for slow cooling but which can also be converted rapidly and conveniently to high speed cooling. Even though uniform, very slow speed cooling is desirable in some limited cases, high speed cooling still must be used for the major tonnage of steel rod that is rolled. Therefore, it is highly unlikely that a modern high speed rod mill will ever be built for very slow speed cooling along. Therefore a successful installation for very slow speed cooling must not only provide uniformity of cooling but it must also be capable of conveniently changing from slow speed cooling to high speed cooling.

Another requirement is certainty of performance. When rod is being drawn into wire, a very high premium is placed on drawability without breaks. For example, if a small percentage of the rod, in excess of predetermined percentages is sufficiently bad to cause breaks in wire drawing at random locations throughout the length, the whole bundle becomes a reject. Of course, breaks in wire drawing are not the only problem. The physical properties of the finished product must also meet the specifications. Moreover, the process must be capable of producing good rod, bundle after bundle. If one bundle out of every five is a reject, and no one can tell in advance which one is the bad bundle, the whole production is suspect. Thus in the cooling of hot rolled rod, a very high degree of perfection is required if the object is to avoid further heat treatment. This is why the above-cited McLain process is so successful. When it is used for plain, medium to high carbon steels, its product meets the required specifications virtually 100% of the time, and it accomplishes this result without requiring the operators to exercise any particular skill in the control. In the same way a process for very slow cooling must be equally sure, simple in its control, and repetitive in its result.

Accordingly the primary object of this invention is to provide an apparatus and a process for very slow speed cooling which accurately controls the cooling rate throughout the length and cross-section of the rod. It is also an object to rake such an apparatus and process readily convertible to high speed cooling and to achieve an infinite control of cooling rates between substantially 0° C/sec. and 20° C/sec. In addition, an objective is to make its operation highly certain and repetitive in its performance once it is initially adjusted.

THE INVENTION

This invention works on the principle of controlling the radiant heat loss of the rod as it lies in spread-out ring form on a moving conveyor. This is done by placing the rod rings on a conveyor in an enclosed housing designed to reduce convection to a fairly insignificent level. The housing is also adapted to absorb radiant energy from the rod selectively according to the concentration of the rod mass. This is done by providing the housing with an insulated roof so as to retain the heat over the centers of the rings and by providing adjustable apertures in the side walls of the housing through which radiant energy from the sides of the rings may escape. The apertures are positioned and arranged for minimum induction of convection. Selective cooling is accomplished by providing an increasing amount of aperture opening, and thereby increasing radiational cooling toward the sides of the conveyor, in proportion to the greater requirement for cooling at the sides. With such a housing uniform cooling at a rate of about 2.0° C/sec. is achieved. Slower cooling is accomplished by introducing heat into the housing by means of radiant heating elements. When this is done the apertures may be closed in which case the heating elements will be arranged to concentrate the heat toward the center of the coneyor. In another mode of operation, the apertures remain open and radiant heat is applied from above uniformly across the width of the conveyor. The advantage of the latter mode is one of simplicity. The ultra slow cooling mode can be initiated merely by turning on the radiant heat. It does, however, involve some waste of energy. The elements which apply radiant heat to the rings may be tubes, in which case they can be converted into cooling elements which absorbe radiant energy from the rings, thus adding as extra degree of radiation control.

The critical feature of the invention is that the cooling rate is controlled by the selective control of radiation as distinguished from convection. This is important in the context of hot rolled rod because heat transfer by radiation tends to equalize more than convection. This is not to say that radiation is the only manner in which cooling takes place, but only that the selective control is performed by controlling the radiation. Thus in its broadest sense, the invention is not limited to very slow cooling. In fact it can even be employed with continuous, fast cooling. For instance, with the above-cited McLain process, greater uniformity of cooling can be achieved by the use of radiant heating elements placed over the center of the conveyor, and used to prevent the convection from cooling the centers of the rings too rapidly. In addition, with such uniformity of cooling on the conveyor, cooling the rod preliminarily with water can be safely carried out to a lower temperature than heretofore, followed by slower continuous cooling on the conveyor so as to give higher tensile strengths without substantial loss of ductibility. This even further extends the usefulness of the said McLain process in the product range of plain, medium-to-high carbon conent steels.

It will be noted that the selective application of radiation can be done by reflection as well as by radiant heaters, and in fact, it usually will be done by a combination of both. Thus, heat emanating from the rod itself which reaches the housing and is reflected back against the rod is to be regarded as part of the applied radiation, and the control of the amount and direction of the reflection is therefore a part of the critical control of the invention.

In addition the amount of variation of the radiant energy to be applied across the rings is calculated to be inversely proportional to the mass flow ratio of the rod along the conveyor. The mass flow ratio, however, varies depending upon the ring spacing. In the context of very slow cooling a conveyor speed of 10 fpm to 30 fpm is contemplated and a ring spacing (on centers) of about 0.2 to 0.6 inch will result from a mill delivery speed of about 10.000 fpm. Having established the desired mass flow ratio, then the gradient of radiation heat loss across the conveyor can be established either by gauging the size of the openings accordingly or by appropriately placing the radiation control elements across the conveyor.

In the interests of simplicity it is preferable to have the radiation control elements all have the same temperature. This can be done by thermocouple with electric resistance heaters, by radiant tubes through which hot gas is passed, or by tubes through which cold gas is passed. In the context of this invention cold gas is about ambient room temperature or lower, while hot gas is above ambient room temperature. The gradient of radiational cooling across the conveyor is then accomplished by varying the spacing between the elements, or by varying the size of the openings or by varying the rate of transmission of heat through the convection barrier. Once the conditions for a given cooling rate are established, the line will maintain it along the conveyor without any more complicated control than the single adjustment of the desired temperature of the radiation control elements. In this way a uniform product is made repetitively and virtually no skill of the operators is required other than to monitor one single temperature adjustment.

DESCRIPTION OF PREFERRED EMBODIMENT

Figure 1:
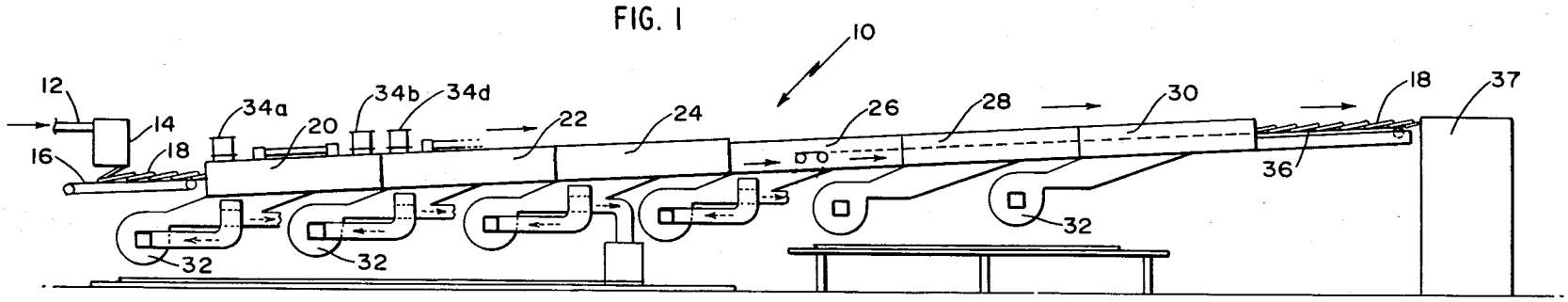
FIG. 1 is a diagrammatic illustration of a side view of an apparatus for cooling hot rolled steel according to this invention; incorporating a plurality of cooling chambers.

In the exemplary embodiment of the present invention as illustrated in the drawings, FIG. 1 shows a continuous cooling apparatus 10, for cooling cold rolled steel rod directly as it issues from the rod mill. The rolled rod issuing from the rod mill at the rolling temperature, for example about 1850° F (1000° C), is directed through a cooling and guide pipe 12 to a laying reel or cone 14. Water may be introduced into the cooling pipe 12 to cool the rod to a suitable initial temperature from which it is to be cooled in the apparatus 10. The magnitude of such initial temperatures depends on the end product requirements, but is usually greater than 1250° F (676° C). Laying cone 14 deposits the rod on a moving conveyor 16 in the form of a spread-out flat ring member 18 consisting approximtely of flat overlapping non-concentric rings as shown more clearly in FIG. 1*a*, U.S. Pat. No. 3,231,432 describes one of several devices which may be used for the laying cone 14.

The conveyor 16 moves the rod rings 18 into a plurality of cooling chambers 20, 22, 24, 26, 28, and 30 where the rod is cooled at a controlled rate to impart the desired tensile strength and ductility in accordance with the principles as described generally above. Each of the cooling chambers is provided with a blower 32 for supplying cooling air directly to the rod rings 18. A plurality of burners 34*a*, 34*b*, —34*d*, —etc, is associated with each cooling chamber. As will be described below, the burners are adapted to supply hot gas to radiation control members for controlling the uniform cooling of the rod.

At the chamber 26, conveyor 16 terminates and transfers the rod to a roller conveyor 36 which carries the rod through the remaining chambers to a ring collecting device 37. The conveyors 16 and 36 are driven by drive chains not shown. The details of the collecting device are also not shown but there are several known suitable devices for this purpose, including that described in U.S. Pat. No. 3,231,432. Within chamber 26, conveyors 16 and 36 extend into mutually abutting relationship in order to facilitate the transfer of the rod 18 from one conveyor to the other.

Figure 3:
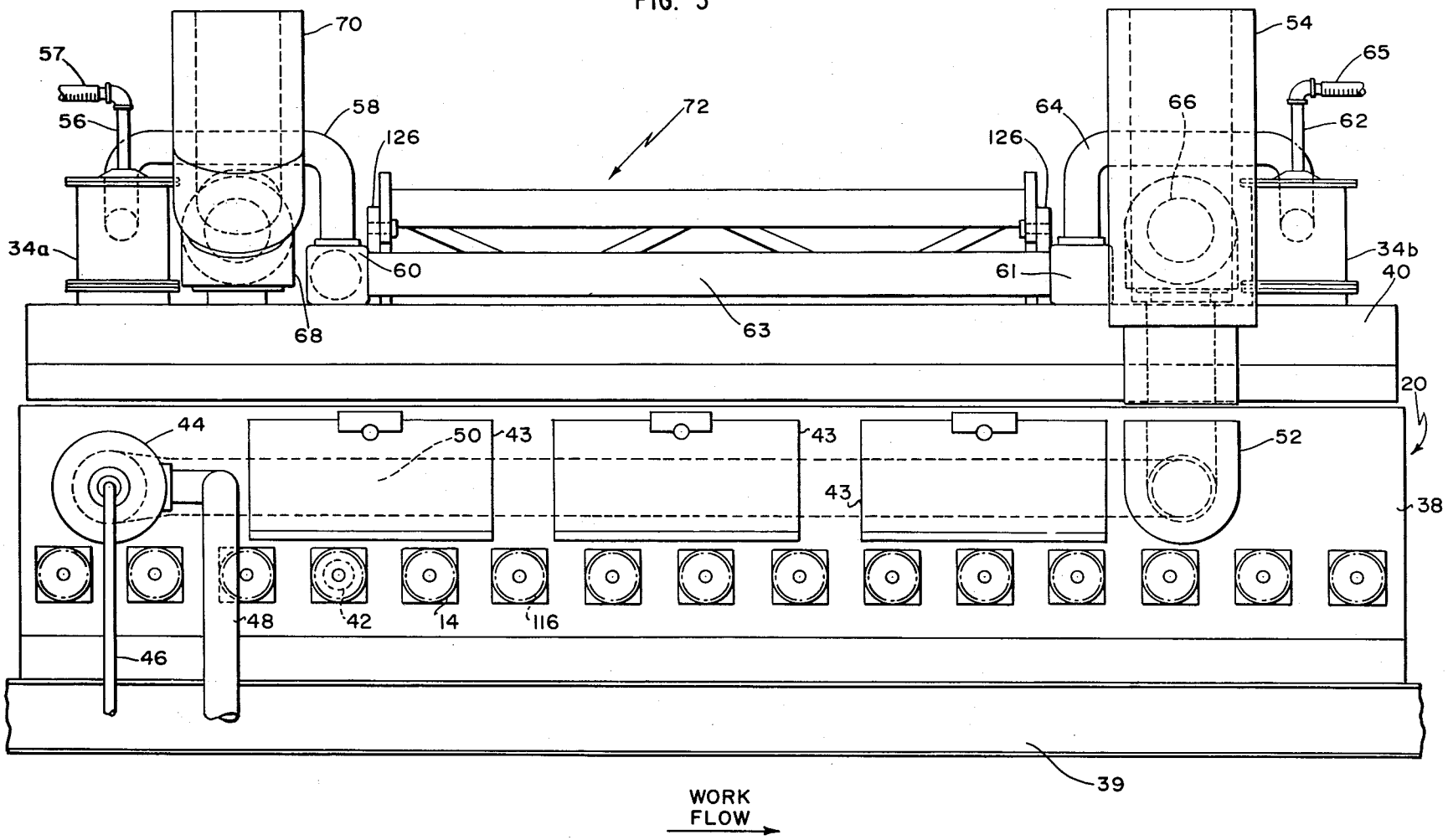
FIG. 3 is a side view of the cooling chamber of FIG. 2 taken in the direction of the arrow 3.
Figure 4:
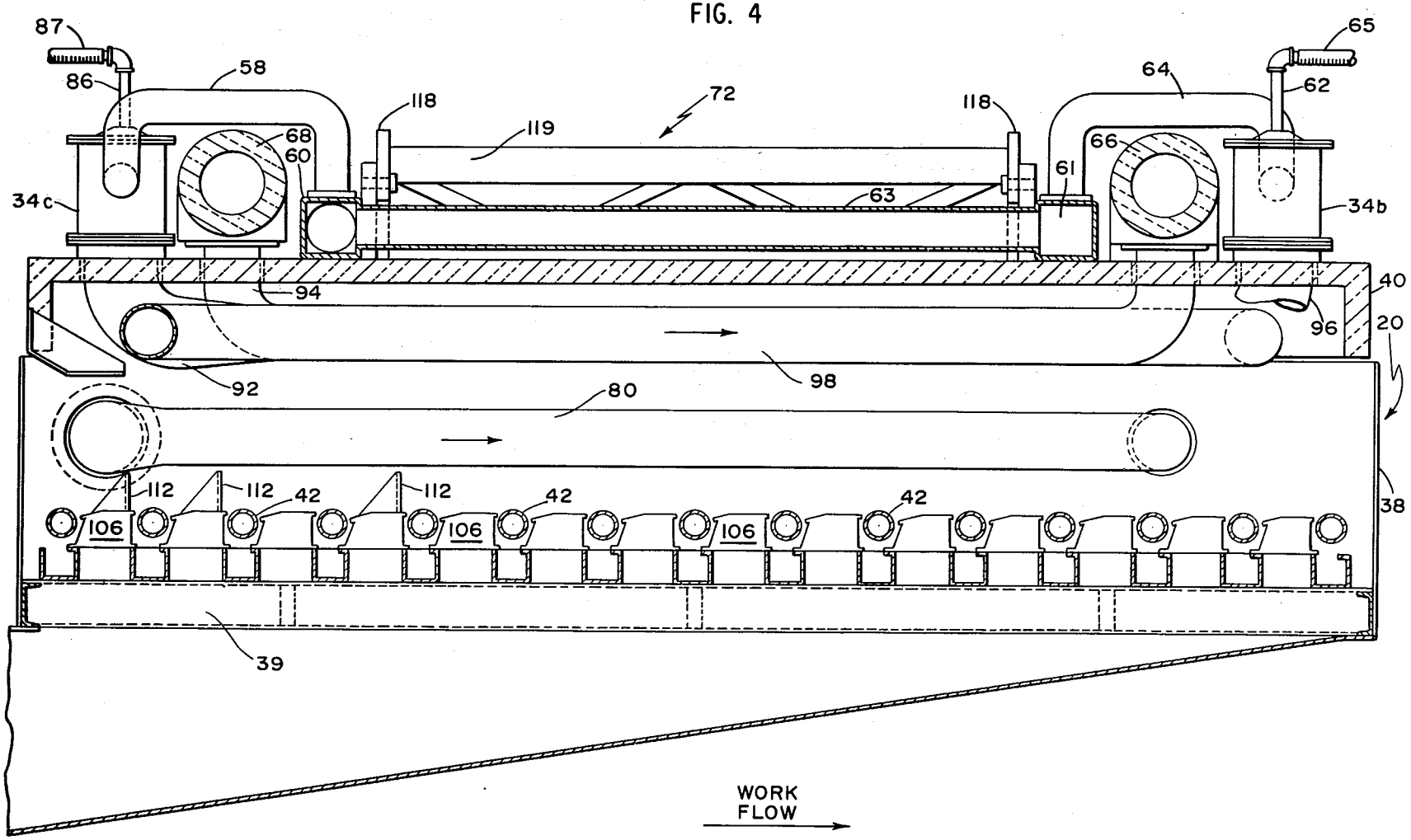
FIG. 4 is a cross section taken along line 4—4 in FIG. 2.

Some of the details of a typical cooling chamber (e.g. chamber 20) may become more apparent by referring firstly to FIG. 3. The chamber 20 is provided with a lower chamber section 38 mounted on the apparatus bed 39 and a movable roof section 40. Projecting through the side walls of section 38 are a plurality of power driven rollers 42, which extend into the interior of the chamber 20 and comprise the conveyor 16 which moves the rod through chamber 20. Mounted on a side wall of section 38 is a plurality of hinged doors 43 which, as will be described below, open and close apertures in the side wall. Also mounted on a side wall of section 38 is a side wall combustion burner 44 which is supplied with fuel gas through a pipe 46 and with air through a conduit 48. Air may be supplied to conduit 48 in any suitable manner from any well known type of air supply. Hot gas from burner 44 passes into a radiation control tube 50, shown in dotted lines in FIG. 3. After being discharged from the tube 50, the exhaust gases emerge from a discharge port member 52 into a gas exhaust assembly 54 fixedly supported above the exhaust end of member 52.

Mounted on the roof section 40 are a plurality of burners, two of which are shown at 34*a* and 34*b*. Burner 34*a* is supplied with fuel gas through a pipe 56 connected through a flexible hose 57 to a controlled source of gas, and with air through a conduit 58, fed from an air manifold 60. Manifold 60 may be supplied with air in any suitable manner. Likewise, burner 34*b* is supplied with fuel gas through pipe 62 and with air through conduit 64 supplied with air from an air manifold 61. Air manifolds 60 and 61 may be interconnected by a transverse conduit 63. Each of the burners 34*a* and 34*b* discharge hot gas through the roof portion 40 into radiation control tubes which will be shown in other FIGS. and will be described below. After having passed through such radiation control tubes, the exhaust gases from burner 34*b* emerge through a discharge port 66 which feeds into exhaust assembly 54. The gases from burner 34*a*, after passing through their radiation control tubes, emerge through a discharge port 68 and feed into an exhaust assembly 70 fixedly supported above the roof member 40.

Roof member 40 is adapted to be raised by a lifting mechanism, part of which is shown in FIG. 3 at 72 and which will be described in greater detail below.

Figure 5:
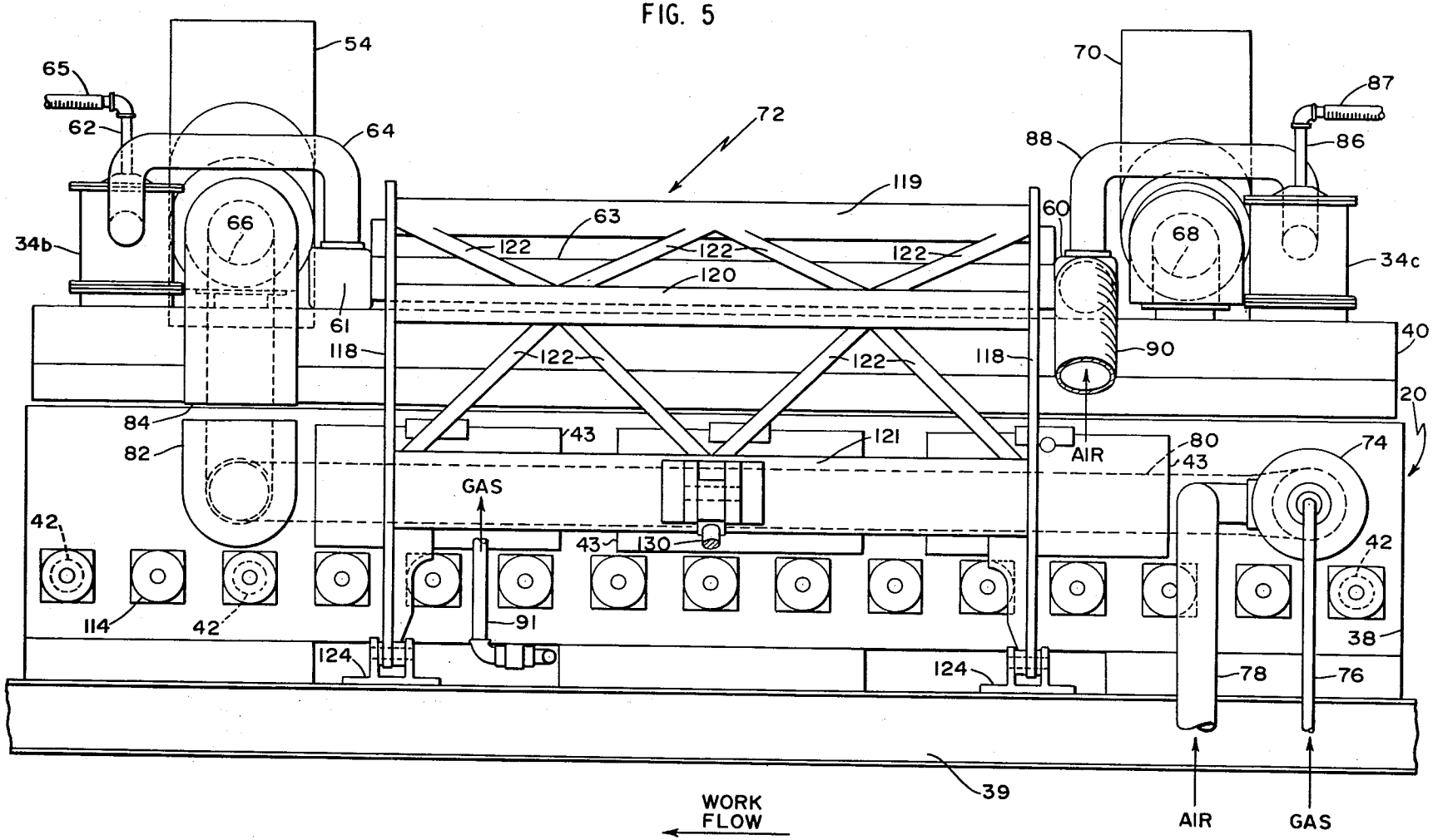
FIG. 5 is a side view of the cooling chambers of FIG. 2 taken in the direction of the arrow 5.

FIG. 5, which views chamber 20 from the opposite side to that of FIG. 3, shows a second side wall burner 74 mounted in the back side wall of section 38. Burner 74 is supplied wih fuel gas through a pipe 76 and with air from an air conduit 78 connected to an air manifold 79 also supplied from any suitable source. Hot gas from burner 74 passes through the back wall of section 38 into a radiation control tube 80 and then out through discharge port 82 which discharges into an inlet-end 84 of the discharge port 66 which also serves to handle the exhaust gases from burner 34*b*. The back side wall, shown in FIG. 5, also is provided with hinged doors 43 which serve the same purpose as the hinged doors 43 shown in FIG. 3. FIG. 5 also shows a third roof burner 34*c* mounted in the roof member 40. It is also supplied with fuel gas through a pipe 86, connected through a flexible hose 87 to a controlled source of gas and with air through an air conduit 88 fed from air manifold 60. FIG. 5 indicates that air manifold 60 is supplied with air from its sources of air through a flexible air hose 90, also connected to air manifold 79 to accommodate movement of roof 40 when raised by the lifting mechanism 77. Although FIG. 5 also shows a portion of the main gas supply 91 which feeds all of the burners.

Figure 2:
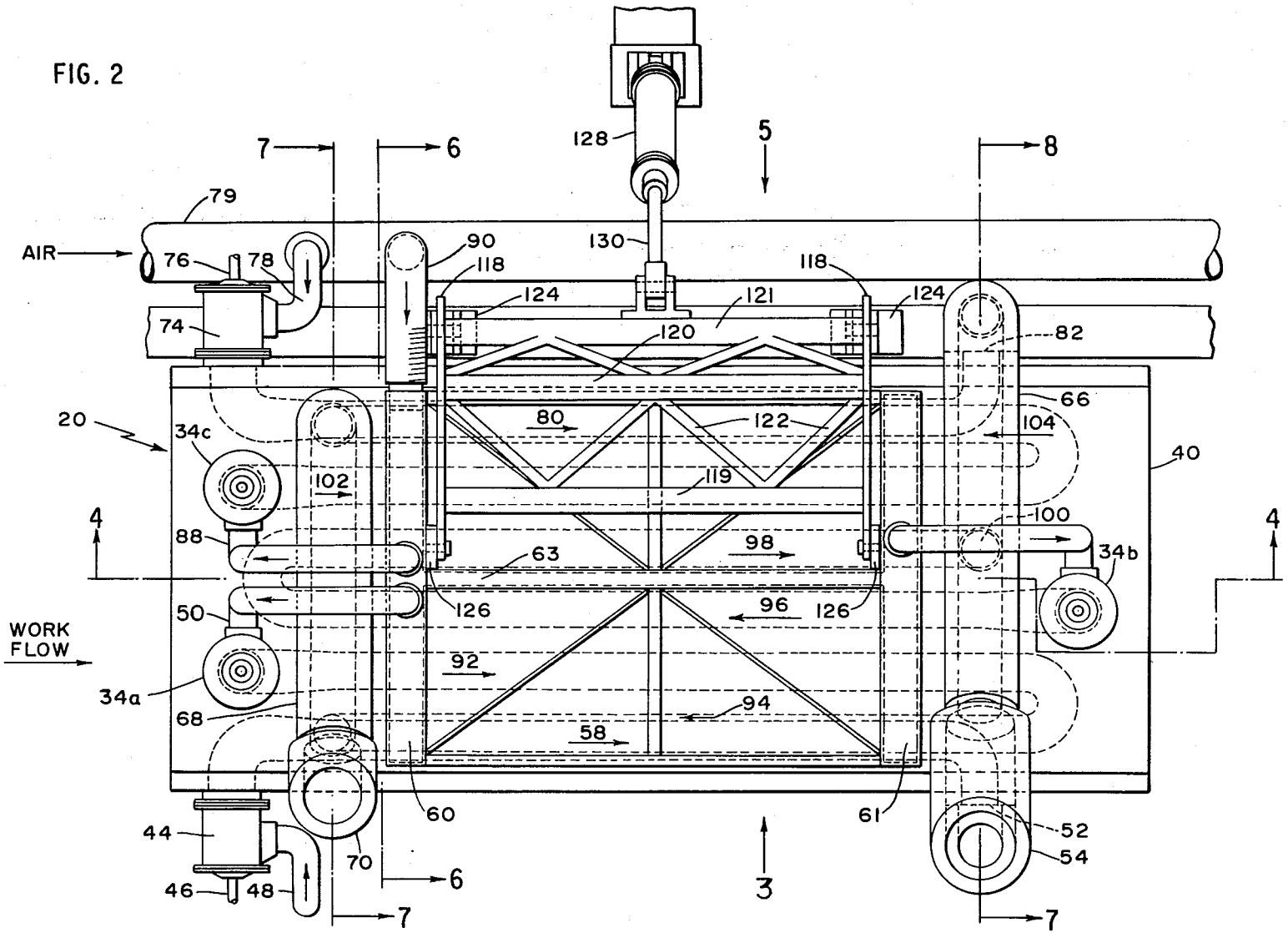
FIG. 2 is top of one of said cooling chambers.

The paths of the flow of hot gas from the various burners may also be traced in FIG. 2. Hot gas from side wall burner 44 flows into tube 50 and out through port 52 into exhaust assembly 54. Likewise hot gas from side wall burner 74 flows into tube 80 and out through port 82 into discharge port 66 which in turn discharges into exhaust assembly 54. Hot gas from roof burner 34*a* flows into tube 92 then back through tube 94, directly above tube 50 and cut through port 68 into exhaust assembly 70. Hot gas from burner 34*b* flows into tube 96 then back through tube 98 and out through an opening 100 into exhaust port 66 and then out through exhaust assembly 54. Hot gas from burner 34*c* flows into tube 102, then back through tube 104, directly above tube 80 and cut through discharge port 68 into exhaust assembly 70.

Figure 9:
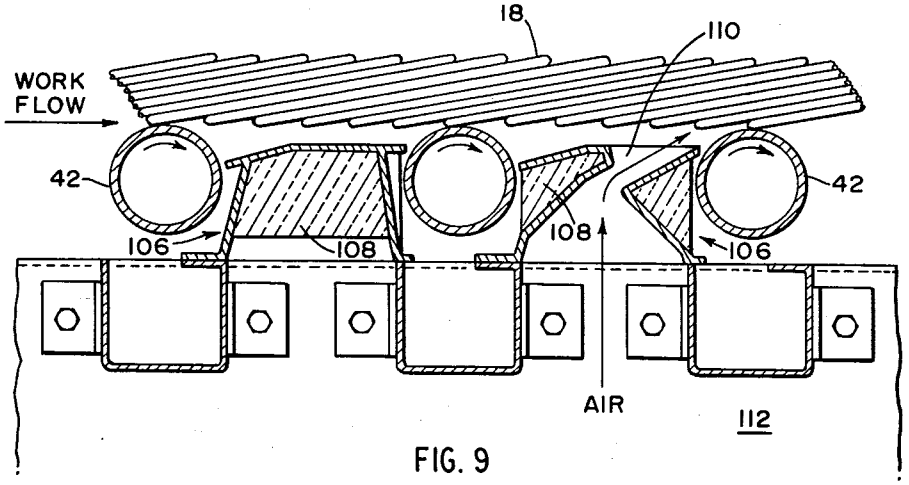
FIG. 9 is an enlarged cross-sectional view of details of the left hand end of the deck assembly shown in FIG. 4.
Figure 6:
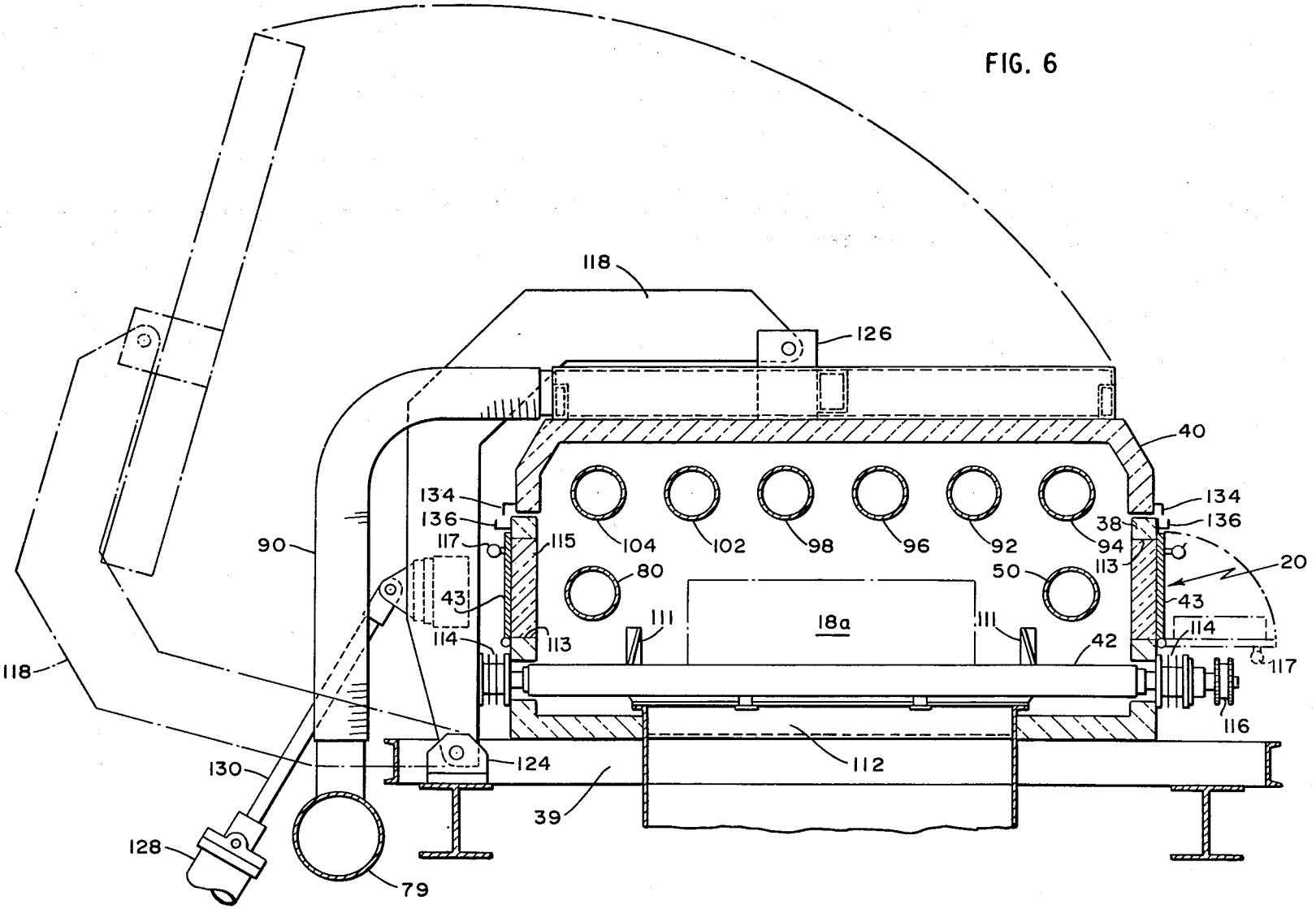
FIG. 6 is a cross-section taken along line 6—6 in FIG. 2.
Figure 7:
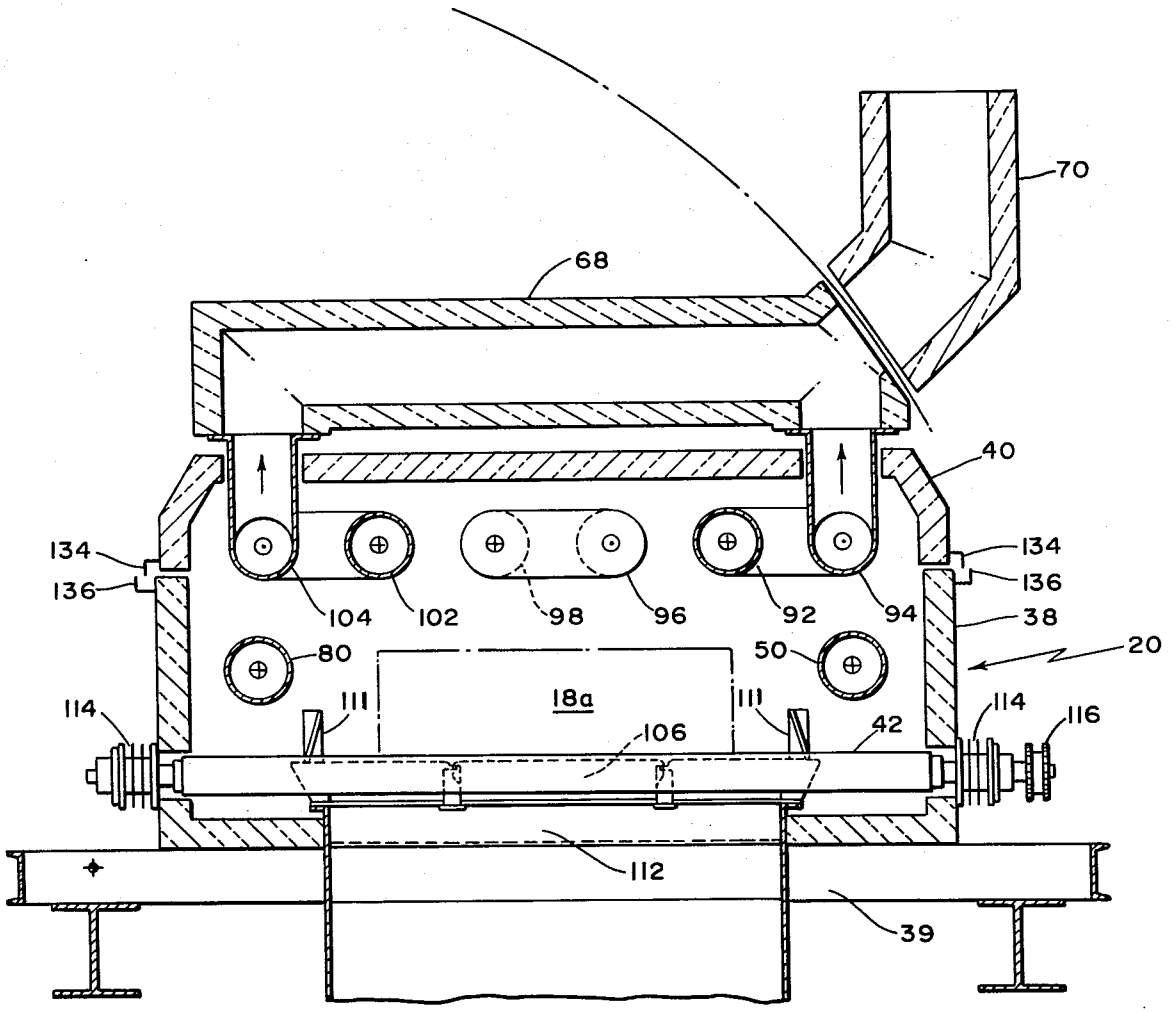
FIG. 7 is a cross-section taken along line 7—7 in FIG. 2.

The internal structure of chamber 20 may be more readily seen from FIGS. 4, 6, 7, 8 and 9, where the reference numbers have the same significance as described above. From FIGS. 4 and 9 it will be seen that, with the exception of the end rollers, each roller 42 rotates between deck elements 106 comprising metal shells encasing insulating material 108, so that such deck elements are maintained at substantially the temperature of the rod rings 18 which pass over such deck elements, without the deck elements extracting any substantial amount of heat from the rod rings 18. Some of the deck elements are preferably provided with air passages 110 so that cooling air supplied from an air manifold 112 from a blower 32 may be passed up through the rod rings 18 under predetermined control conditions to cool the rod rings 18 in the described manner. Some or all of the deck elements 108 may be provided with side guide plates 111 to prevent excessive side motion of the rod coils 18. In FIGS. 6, 7, and 9, the bearings in which the rollers 42 rotate are designated at 114; and the sprockets which may be used drive the rollers by the drive chain are designated at 116.

As shown, for example in FIG. 6, the walls of the chamber 20 and of the roof 40 are made of heat insulating material so that a substantial amount of the heat which is radiated from the mass of spread-out rod rings, indicated diagrammatically by the rectangle 18*a*, is reradiated or reflected back toward the rings mass.

Each side wall of section 38 is provided with a plurality of apertures 113 which are adapted to be closed or plugged by aperture closures 115 made of the same heat insulating material as the walls of chamber 20. Each closure 115 is mounted on the back of one of the hinged doors 43 which, by means of a suitable handle 117, may be operated to move its closure 115 from its completely closed position, as shown by the solid lines in FIG. 6, to its completely opened position, as shown by the broken lines. A suitable latch, not shown in detail, may be provided to retain each door in its closed position and the door hinges, not shown in detail, may be of the type to permit each door to be held in any of a plurality of positions between its completely open and completely closed positions.

The roof 40 may be removed from the section 38 by providing the mechanism 72. Mechanism 72 comprises a frame including a pair of substantially L-shaped lever arms 118—118 connected to each other by a plurality of cross bars 119,120, and 121. The resulting frame structure is further strengthened by bracing structures 122. The arms 118—118 are pivoted at their lower ends to a pair of brackets 124—124 rigidly secured to the apparatus bed 39. The upper ends of arms 118—118 are pivoted to a pair of brackets 126—126 rigidly secured to the roof 40. The force for moving the roof 40 is supplied by a hydraulic cylinder 128 which moves a rod 130 pivotally connected to the cross bar 121. Hydraulic cylinder 128 may be controlled to lift roof 40 from the closed position, as shown by the solid lines in FIG. 6, the position, as shown by the broken lines, where the top of section 38 is completely uncovered permitting substantially unimpaired radiation of heat from the ring mass 18*a* through the top of section 38.

Figure 8:
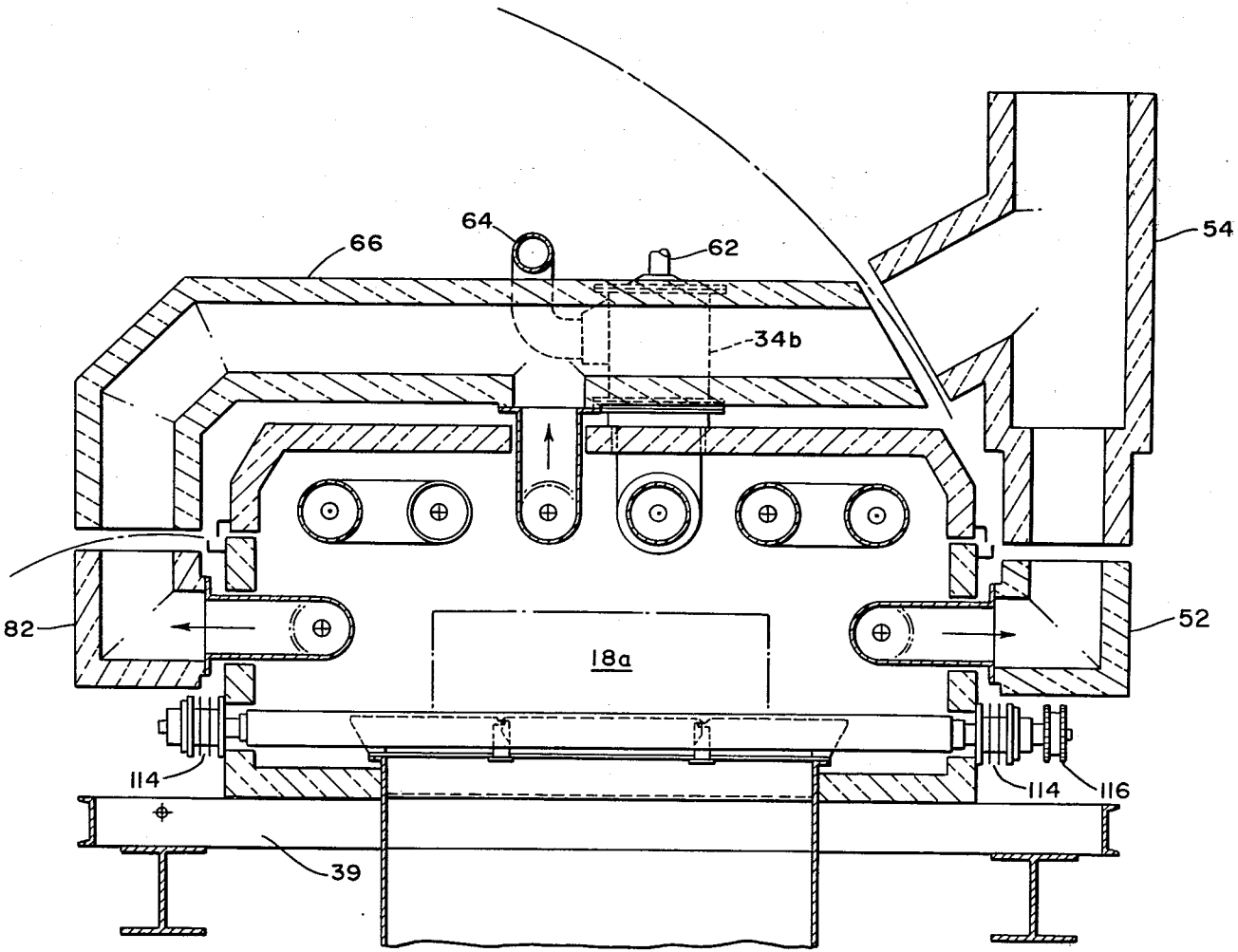
FIG. 8 is a cross-section taken along line 8—8 in FIG. 2.

As will be seen in FIGS. 7 and 8, in order to provide for the motion of roof 40, spacings are provided between the section 38 and the roof 40, between the stationary exhaust assembly 70 and the movable discharge port 68, and between the stationary exhaust assembly 54 and the movable discharge port 66. In order to accommodate differential thermal expansion spacing is also provided between the exhaust port 52 and the exhaust assembly 54.

In the closed position of the roof 40, it is desirable that air flow out of the top of section 38 be kept at a minimum in order to keep convection currents at a minimum. For this purpose, as shown in FIGS. 7 and 8, air baffle plates 134 along the lower edges of roof 40 cooperate with air baffle plates 136 along the upper edges of section 38 to inhibit the free flow of air through the spacing between the roof 40 and the section 38.

Figure 10:
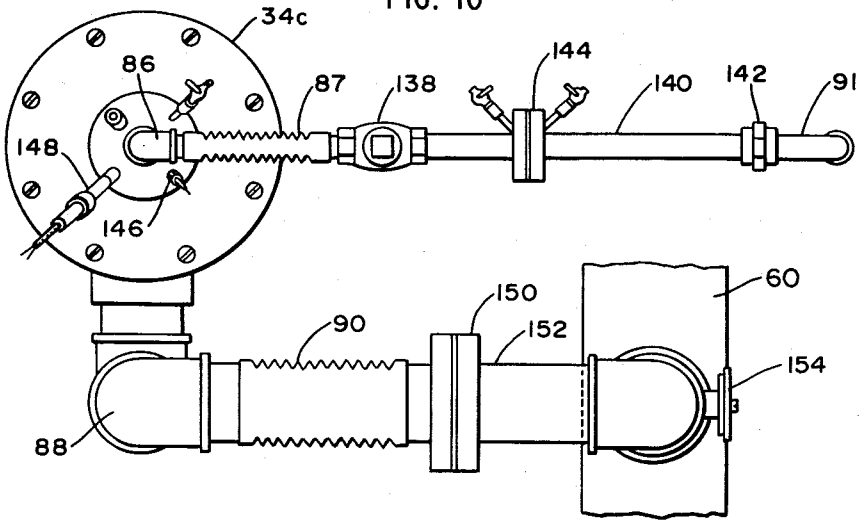
FIG. 10 is a detailed view of the connections to the top of one of the roof burners shown, for example, in FIG. 2.

Flexible hoses 57, 65, 87 and 90 are provided to preserve the connection of air and gas to roof burners 34*a*, 34*b*, and 34*c* despite the motion of the roof 40. A more detailed showing of the arrangement of these hoses and of the controls associated with the various burners appears in FIG. 10 which gives a top view of the burner 34*c*, by way of a typical example. The pipe 86 is connected through the flexible hose 87 to a limiting orifice valve 138 mounted on the end of the stationary pipe 140; the outer end of which is connected by a coupler 142 to the main gas supply 91. Interposed in the pipe 140 is an orifice assembly 144 for further regulating the flow of gas. A spark plug 146 is provided in the cover of burner 34*c* to ignite the gas. A flame monitoring device 148 such as a ultra violet scanner which provides an indication of the state of the flame within the burner 34*c* may also be provided in the cover of burner 34*c*. The air conduit 88 is connected through the flexible hose 90 which is connected through a pipe union 150 and piping 152 to the air conduit 78. Interposed in the piping 152 is a control butterfly valve 154. Thus, not only is the burner 34*c* connected so as to accomodate the relative motion between the roof 40 and section 38 but is also supplied with controls such that the amount and temperature of the hot gas delivered by the burners can be clearly regulated. It is understood that each of the other roof burners as well as the side wall burners are provided with similar controls.

Instead of the radiation control tubes being supplied with hot gases from the roof and side wall burners, such tubes could be supplied with cold air at any desired predetermined temperature. For this purpose, the burners could be any well known type of apparatus which can be controlled to supply either hot or cold gases instead of only hot gases. Instead of such double purpose devices, alternative supplies of temperature controlled cold gas, such as air, could be connected to supply such cold gas to the several radiation control tubes when the burners are shut off.

The equipment as described above is particularly adapted to achieve the primary object of this invention which is to cool the heated rod 18 at a very low cooling rate under such accurately controlled conditions that the rod is delivered to the collecting device with desired relatively uniform physical properties and microstructure. These results may be more clearly understood from the following description of the operation of the equipment.

Figure 1A:
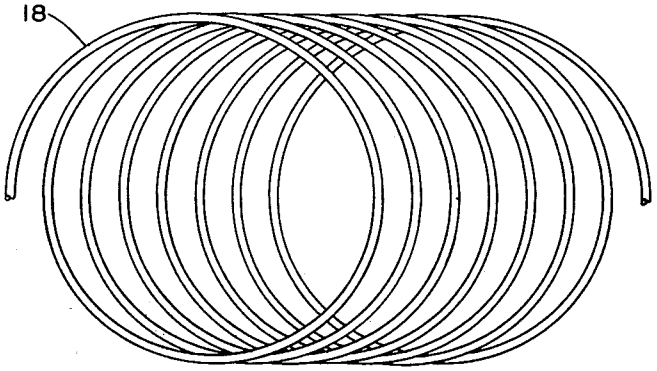
FIG. 1*a* is a top view of a typical form of a spread-out rod rings passing through the apparatus of FIG. 1.

When one looks at the spread-out rings 18*a* in FIG. 1*a* it will be seen that the mass of rod metal per unit length along the direction of flow through the apparatus, which may be termed "the accumulated mass" of the rods is greatest at the sides of the ring mass where the successive rings rest upon each other. The accumulated mass of the rod is a minimum at the center of the coil where the rings are separated from each other and is a maximum at the sides where the rings are in contact with each other. Due to the configuration of the spread-out rings 18, the central portion of the rings tends to radiate heat more readily than do the side portions. Although the outside surface of each rod, either at the edges of the ring mass or at the center radiates approximately equally, the compactness of the ring mass at the edges causes the average cooling rate of the mass at the edges to be less than the average cooling rate of the ring mass in the center. Therefore, if the rings 18 were allowed to cool by normal radiation loss, without some external modification of such radiation, the edges would cool more slowly than would the centers. A typical result is given in the preliminary discussion above in which the edges cool at about 1.6° C/sec. to 2.1° C/sec. and the centers cool at about 2.3° C/sec. to 2.8° C/sec. depending upon the spacing of the rings. According to this invention, however, the rates of radiation from various portions of the rings may be modified to eliminate the above unequal cooling of the rings. Further the apparatus described above provides means for producing a wide variety of radiation modifying conditions to accomplish the desired result under different operating conditions.

Figure 11:
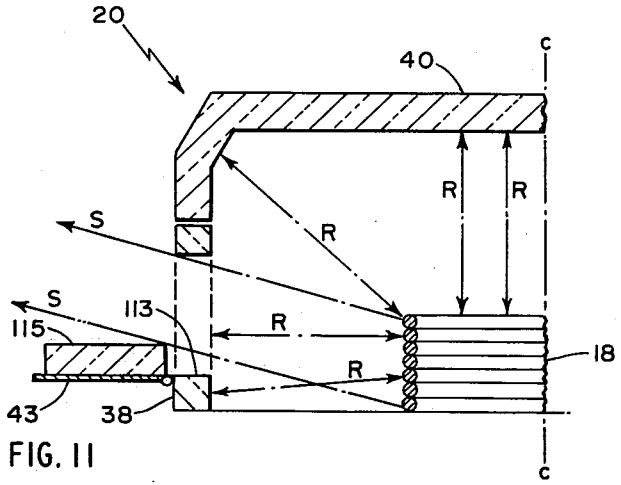
FIG. 11 is a fragmentary cross-section of a portion of one of the cooling chambers illustrating modes of operation with open and closed side wall apertures.

FIG. 11 represents a mode of operation in which the equalization of cooling is accomplished by the provision of the aperture 113 and closures 115. However, when the closure 115 is moved to its open position, as shown in solid lines, it uncovers the aperture 113 and opens a gap through which radiant energy may escape. Therefore, with the roof 40 in its closed position and the apertures 113 closed by the closures 115, as shown in the dotted line position in FIG. 11, the inner walls of the chamber 20 intercept heat radiation, represented by the broken lines R, from the coils 18 and, by reflection inhibit cooling by radiation. However, when the closure 115 is moved to its open position, as shown in solid lines, it uncovers the aperture 113 and opens a gap through which radiant energy may escape. Therefore, any radiation, shown in solid lines, which falls upon the gap, passes out of the chamber and is lost. Therefore the gap does not limit the loss of radiation, so that any portion of the rings 18 which can lose radiation through the gap more easily than any other portion, will have its rate of energy loss increased over that of any other portion. It will be noted that the edges of the rings 18 are more directly in line with the gap than are the centers of such rings. As a result, the normal tendency of the edges to cool more slowly than the centers is decreased so that by proper adjustment of the gap, the cooling rates may be made substantially equal. It will be seen that the size of the gap will depend upon the position at which the closure 115 is held between its completely closed and completely open position. It is also to be understood that apparatus is so structured that other openings into or out of the chamber 20 are blocked so as to restrict air paths which might induce any undesirable degree of convection in this mode of operation. For purposes of clarity, the radiation control tube normally adjacent the side wall (e.g. 50 or 80) is not shown in FIG. 11. Although such tube may occupy a position in front of the aperture 113, it does not introduce sufficient interference with the escape of radiant energy through the aperture 113 to prevent the desired result of proper control of the cooling of the edges of the ring nose. In some modification such side wall radiation control tubes 50 and 80 may be omitted entirely.

Figure 12:
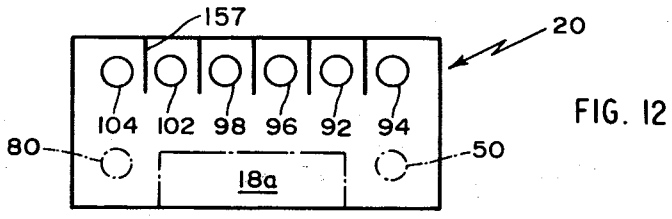
FIGS. 12, 13 and 14 are diagrams illustrating additional modes of operation of the apparatus.

Another mode of operation of the equipment is represented in FIG. 12 in which the roof 40 is in its completely closed position. In this mode heated gas from the roof burners 34*a*, 34*b*, and 34*c* only is supplied to radiation control tubes 92, 94, 96, 98, 102, and 104 while side wall burners 44 and 76 are not operated and tubes 50 and 80 are not heated. The tubes to which the hot gas is supplied are heated to a temperature sufficiently less than that of the entering rod rings 18 to permit such rings to lose heat primarily by radiation. If the temperature of the heated gas entering all of the radiation control tubes is the same, nevertheless the temperatures of the radiation control tubes themselves will tend to reach a distribution in which the temperature is greatest over the center of the rings and a minimum over the edges of the rings. This may be better understood by noting that the center tubes 96 and 98 are shielded by adjacent tubes, while, as we progress sideways, the tubes 92 and 102 and 94 and 104 are progressively less shielded. The result is that the center tubes tend to reach and maintain a higher temperature than the end tubes 94 and 104. In addition it will be noted that the hot gas from roof burner 34*a* first enters tube 92 and passes out along tube 94. Since there is a drop in temperature of the gas in such passage, the tendency of tube 94 to be at a lower temperature than tube 92 is increased. A similar state exists with respect to tubes 102 and 104. The overall resulting temperature distribution of the tubes 92, 94, 96, 98, 102, and 104 is in the proper direction to achieve the desired uniform cooling of the rod rings 18.

Since each of the burners may be independently controlled, the proper temperature distribution of the radiation control tubes may be achieved by having the hot gas entering the central tubes raised to a higher temperature than the gas entering the tubes at the ends and sides of the cooling chamber 20.

Figure 13:
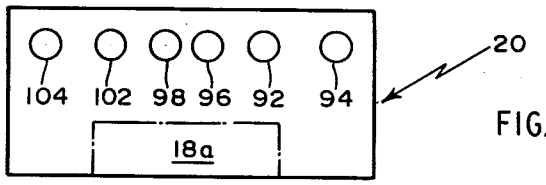

Another arrangement for achieving the desired temperature distribution among the radiation control tubes is represented in FIG. 13 in which the tubes are spaced more closely to each other at the center of the chamber 20 than at the sides.

Figure 14:
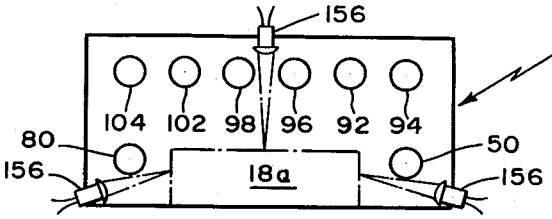

The slowest cooling mode is represented by FIG. 14 in which all of the radiation control pipes are supplied with heated gas. Of course it is to be understood that the proper temperature distribution, as explained above, is to be maintained. FIG. 14 also indicates that, due to the fact that each burner may be controlled individually, it is possible to provide for automatic adjustment of the radiation control temperature in response to the temperature of the rings 18. For example, the apparatus may be provided with thermostatic controls 156 of the type which may be optically focused upon selected portions of the rings 18 to measure the temperature of such portions. One thermostat may be used to measure the temperature of the center of the ring mass 18*a* while one or more additional thermostats may be used to measure the temperature at the sides of such mass. The signals from the thermostats may then be used to control the energization of the various burners to maintain the desired uniform cooling of all portions of the ring mass 18*a*.

The fastest cooling mode of operation of the apparatus is that in which the roof 40 is completely lifted away from its lower section 38, as for example in FIG. 6. In this mode, cooling air at the desired rate is blown through air passages 110 (See FIG. 9) to achieve the desired fast cooling. The provision in the apparatus of means for supplying such cooling air affords an additional flexibility of operations since, in the other operational modes as described above, it maybe desirable to introduce some cooling air to achieve the exact rate of cooling desired.

Other modifications may involve a change in the number of burners and radiation control members for each cooling chamber, a larger number increasing the fineness of control. Other types of radiation control members may be used. For example they might consist of electrically heated refractory rods instead of heated or cooled gas tubes.

In addition, retractable baffles 157 (see FIG. 12) may be employed between the heating elements to further increase the ability of individual temperature control. Other modifications, within the scope of the appended claims will suggest themselves to those skilled in the art.

I claim:

1. An apparatus for treating hot steel rod comprising:

a. a cooling chamber;

b. a conveyor adapted to receive hot steel rod in the form of spread-out rings and for moving said rings through said chamber;

c. the interior of said chamber being provided with radiation control means having a plurality of extended surfaces facing said conveyor and displaced therefrom whereby a space is provided through which said conveyor is adapted to move said rod;

d. some of said surfaces being disposed adjacent the center of said conveyor on which the center of said rings are carried and others of said surfaces being disposed adjacent the sides of said conveyor on which the edges of said rings are carried;

e. temperature control means for maintaining said surfaces adjacent the center of said conveyor at preselected temperatures and for maintaining said surfaces adjacent the sides of said conveyor at other preselected temperatures;

f. and means for controlling said temperature control means to maintain the first of said preselected temperatures at higher value than the second of said preselected temperatures;

g. said radiation control means comprising spaced heating elements.

2. Apparatus as in claim 1 in which said radiation control means also comprises retractable baffles between said spaced heating elements.

3. Apparatus as in claim 1 in which said spaced heating elements comprise electrical resistance radiant heaters.

4. An apparatus for treating hot steel rod comprising:

a. a cooling chamber;

b. a conveyor adapter to receive hot steel rod in the form of spread-out rings and for moving said rings through said chambers;

c. the interior of said chamber being provided with radiation control means having a plurality of extended surfaces facing said conveyor and displaced therefrom whereby a space is provided through which said conveyor is adapted to move said rod;

d. some of said surfaces being disposed adjacent the center of said conveyor on which the center of said rings are carried and others of said surfaces being disposed adjacent the sides of said conveyor on which the edges of said rings are carried;

e. temperature control means for maintaining said surfaces adjacent the center of said conveyor at preselected temperatures and for maintaining said surfaces adjacent the sides of said conveyor at other preselected temperatures;

f. and means for controlling said temperature control means to maintain the first of said preselected temperatures at higher values than the second of said preselected temperatures, g. said radiation control means comprising a plurality of tubes, and said temperature control means comprising means for supplying hot gas from a plurality of separately controllable gas heaters, each of which is connected to supply heated gas to different ones of said tubes.

* * * * *

UNITED STATES PATENT AND TRADEMARK OFFICE

CERTIFICATE OF CORRECTION

PATENT NO. : 4,054,276

DATED : October 18, 1977

INVENTOR(S) : Norman A. Wilson

It is certified that error appears in the above-identified patent and that said Letters Patent are hereby corrected as shown below:

COLUMN 2, Line 5, after "medium" delete "tohigh" and substitute --to high--

COLUMN 2, Line 37, after "1400°F delete "700°C)" and substitute --(700°C)--

COLUMN 2, Line 48, after "2.1°C/sec." add --, and the centers cool at about 2.3°C/sec. to 2.8°C/sec.--

COLUMN 2, Line 68, after "cooling" delete "along." and substitute --alone.--

COLUMN 4, Line 30, after "carbon" delete "conent" and substitute --content--

COLUMN 4, Line 48, after "about" delete "10.000" and substitute --10,000--

COLUMN 6, Line 63, after "supplied" delete "wih" and substitute --with--

COLUMN 7, Line 14, delete "77." and substitute --72.--

UNITED STATES PATENT OFFICE

CERTIFICATE OF CORRECTION

Patent No. 4,054,276 Dated October 18, 1977

Inventor(s) Norman A. Wilson

It is certified that error appears in the above-identified patent and that said Letters Patent are hereby corrected as shown below:

Column 7, line 24, after "and" delete "cut" and substitute -- out --.

Signed and Sealed this

Seventh Day of March 1978

[SEAL]

Attest:

RUTH C. MASON
*Attesting Officer*

LUTRELLE F. PARKER
*Acting Commissioner of Patents and Trademarks*